US010789919B2

(12) United States Patent
Rognlien et al.

(10) Patent No.: US 10,789,919 B2
(45) Date of Patent: Sep. 29, 2020

(54) ACOUSTIC GUITAR STRAP LOCK ADAPTER

(71) Applicant: Music Nomad, LLC, Sonoma, CA (US)

(72) Inventors: Rand Rognlien, Sonoma, CA (US); Glen C. Wolff, Lakeside, CA (US)

(73) Assignee: Music Nomad, LLC, Sonoma, CA (US)

( * ) Notice: Subject to any disclaimer, the term of this patent is extended or adjusted under 35 U.S.C. 154(b) by 0 days.

(21) Appl. No.: 16/709,086

(22) Filed: Dec. 10, 2019

(65) Prior Publication Data

US 2020/0193945 A1 Jun. 18, 2020

Related U.S. Application Data

(60) Provisional application No. 62/779,668, filed on Dec. 14, 2018.

(51) Int. Cl.
*G10G 5/00* (2006.01)

(52) U.S. Cl.
CPC ..... *G10G 5/005* (2013.01)

(58) Field of Classification Search
CPC .. G10G 7/00; G10D 3/00; G10D 9/00; G10D 13/00
See application file for complete search history.

(56) References Cited

U.S. PATENT DOCUMENTS 7,718,875 B2 * 5/2010 Shereda ..... G10G 5/005 84/327
2016/0027417 A1 * 1/2016 Koster ..... A44B 13/0058 84/327

* cited by examiner

*Primary Examiner* — Kimberly R Lockett

(57) ABSTRACT

An acoustic guitar strap lock adapter that utilizes a conventional strap lock system in a manner that does not require modification to be made to the guitar. The adapter includes an elongated body having first and second ends, a first opening formed through the elongated body adjacent the first end thereof and being internally threaded to co-axially engage with the guitar's pick-up jack; and a second opening formed through the elongated body adjacent the second end thereof and being configured to securely receive a strap lock therein, whereby the guitar strap can be anchored to the acoustic guitar at a position offset from the pick-up jack.

6 Claims, 9 Drawing Sheets

ACOUSTIC GUITAR STRAP LOCK ADAPTER

CROSS REFERENCE TO RELATED APPLICATIONS

This application relates and claims priority to U.S. Provisional Application No. 62/779,668, filed on Dec. 14, 2018, the entirety of which is hereby incorporated by reference.

FIELD OF THE INVENTION

The present disclosure is directed generally to guitar strap locks, and more particularly to adapters for guitar strap locks for use on acoustic guitars that do not require modification to be made to the guitar body.

BACKGROUND

Electric guitars have two metal buttons (see FIG. 1) integrated into their design to which a guitar strap (see FIG. 2) to be attached and permit the guitar to hang around the player's body in the playing position. The strap buttons are held in place with wood screws driven directly into the guitar body, one on the upper bout or horn and the other centered on the tail end. Guitar straps come equipped with holes formed in their ends so they can slip over the strap buttons provided on the electric guitars.

The problem with this traditional design is a risk of the strap slipping off the strap button while playing the guitar, which could cause it to fall off the player and become damaged. Many players thus choose to use a strap lock system that securely attaches the strap to the guitar with a metal locking mechanism. There are several designs to choose from that all function similarly, such as one shown in FIGS. 3A-3D that is manufactured by Schaller. The strap lock uses specially designed strap buttons that are installed on a guitar in place of the standard strap buttons, and a mechanism that installs on the ends of the strap that click onto those buttons to securely fasten (lock) the strap in place. With strap locks holding the strap in place, the strap is far less likely to accidentally slip off the button.

While this is a useful safety feature, it cannot be used on acoustic guitars. While most acoustic guitars have a common strap button on the heel of the neck (see FIG. 4) that can be replaced with a strap lock pin, the strap attachment at the tail of the guitar is part of the electronics/pickup output jack assembly (see FIG. 5). A performance ready acoustic guitar with a built in pickup typically has this type of "jack cap" strap attachment at the tail end. This is the output jack that the guitar cable plugs into with an end cap that threads on. The cap has a channel that the strap rests in. Many players struggle with fitting the strap over this larger opening and never feel secure with the fit (see FIG. 6).

As seen in FIG. 7, some players who want to avoid fitting the strap over the jack or incorporate strap locks will add an additional strap pin to the bottom of the guitar. However, this requires drilling a hole in the guitar body, something many players are hesitant to do as this creates an irreversible modification to the instrument.

Accordingly, there is a need in the art for a strap lock adapter for acoustic guitars that utilizes existing structure on the guitar, and does not require modification to be made to the guitar body.

SUMMARY

The present disclosure is directed to a guitar strap lock adapter for use on an acoustic guitar.

According to an aspect is a guitar strap lock adapter for use on an acoustic guitar having a pick-up jack on the body thereof, comprises an elongated body having first and second ends; a first opening formed through the elongated body adjacent the first end thereof and being internally threaded to co-axially engage with the pick-up jack; and a second opening formed through the elongated body adjacent the second end thereof and being configured to securely receive the strap lock therein, whereby the guitar strap can be anchored to the acoustic guitar at a position offset from the pick-up jack.

According to an embodiment, the guitar strap lock adapter for use on an acoustic guitar having a pick-up jack having a maximum diameter on the body thereof, comprises an adapter assembly of elongate shape that is configured and adapted for placement around the pick-up jack adjacent a first end thereof and having an opening formed therethrough adjacent a second end thereof offset from the first end; a lock button positioned in axial alignment with the opening; and a fastening element for retaining the adapter assembly and lock button together.

According to an embodiment, the adapter assembly comprises a cover plate and a keyhole ring.

According to an embodiment, the keyhole ring comprises an elongated body having a first end adjacent which a first opening of predetermined diameter is formed and a first slot of predetermined width that intersects with the first opening is formed, and a second end adjacent which a second opening is formed.

According to an embodiment, the predetermined diameter of the first opening is greater than the maximum diameter of the pick-up jack and the predetermined width of the first slot is smaller than the maximum diameter of the pick-up jack.

According to an embodiment, the cover plate is of a shape essentially the same as the keyhole ring, and includes an elongated body having a first end through which a second slot is formed, and a second end adjacent which a third opening is formed.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

The present disclosure describes an acoustic guitar strap lock adapter.

Figure 1:
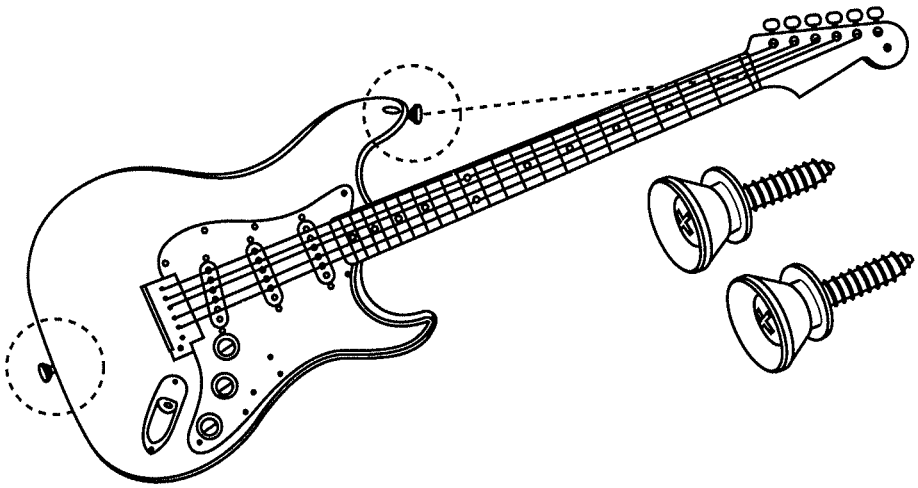
FIG. 1 PRIOR ART
FIG. 1 is a perspective view of a prior art electric guitar.
Figure 2:
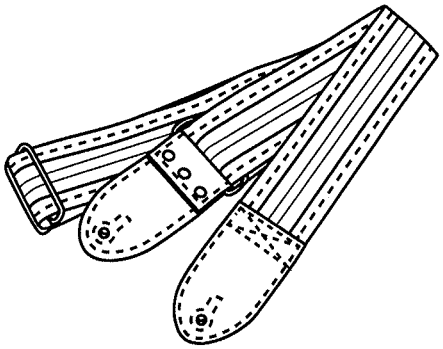
FIG. 2 PRIOR ART
FIG. 2 is a perspective view of a prior art guitar strap.
Figure 3A:
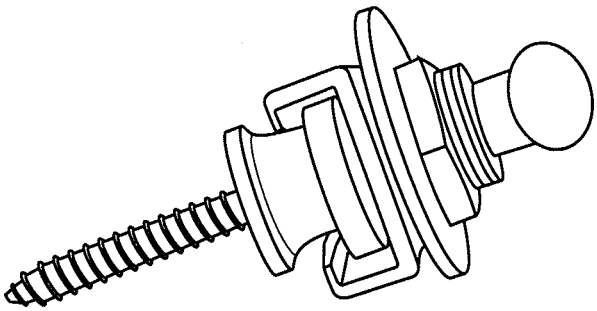
FIG. 3A PRIOR ART
FIGS. 3A-3D are perspective views of prior art guitar strap locks.
Figure 3B:
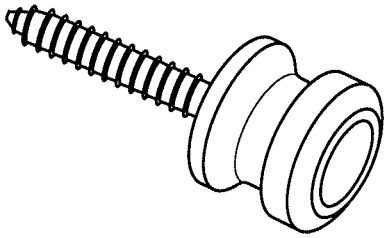
FIG. 3B PRIOR ART
Figure 3C:
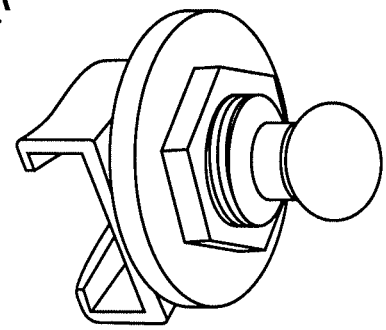
FIG. 3C PRIOR ART
Figure 3D:
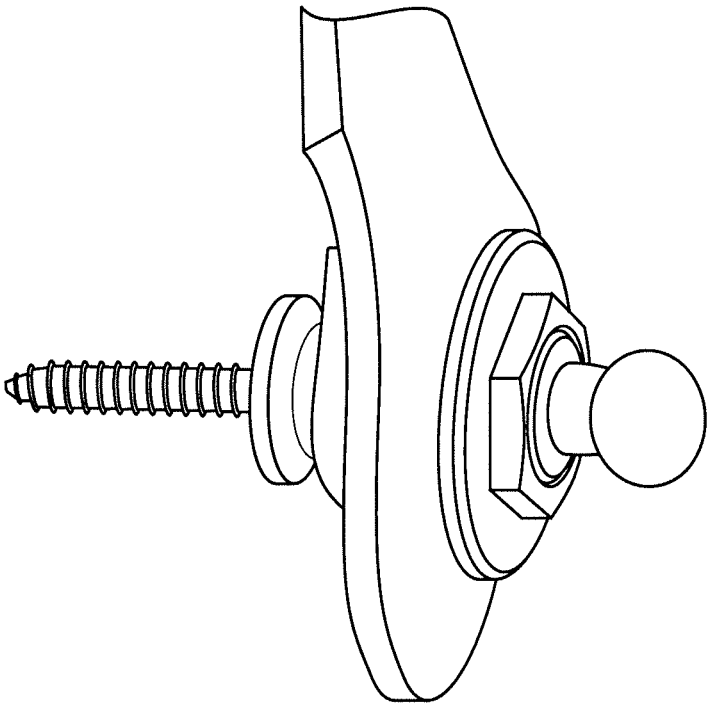
FIG. 3D PRIOR ART
Figure 4:
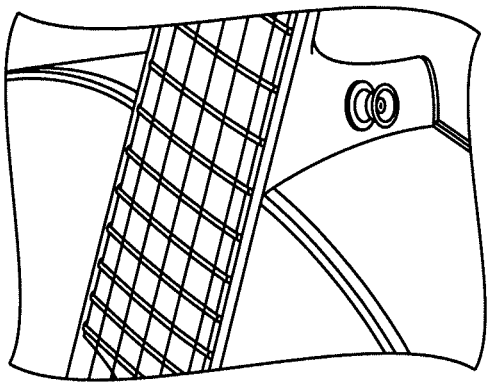
FIG. 4 PRIOR ART
FIG. 4 is a close up perspective view of the neck of a prior art acoustic guitar.
Figure 5:
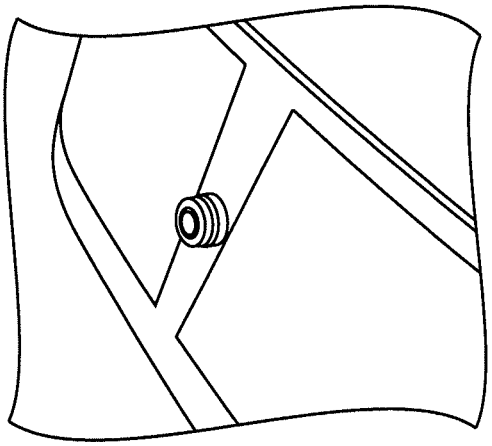
FIG. 5 PRIOR ART
FIG. 5 is a close up perspective view of the bottom of a prior art acoustic guitar body.
Figure 6:
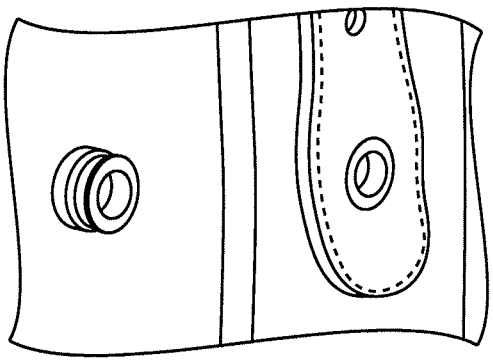
FIG. 6 PRIOR ART
FIG. 6 is a close up perspective view of the bottom of a prior art acoustic guitar body with a guitar strap placed over the jack pin.
Figure 7:
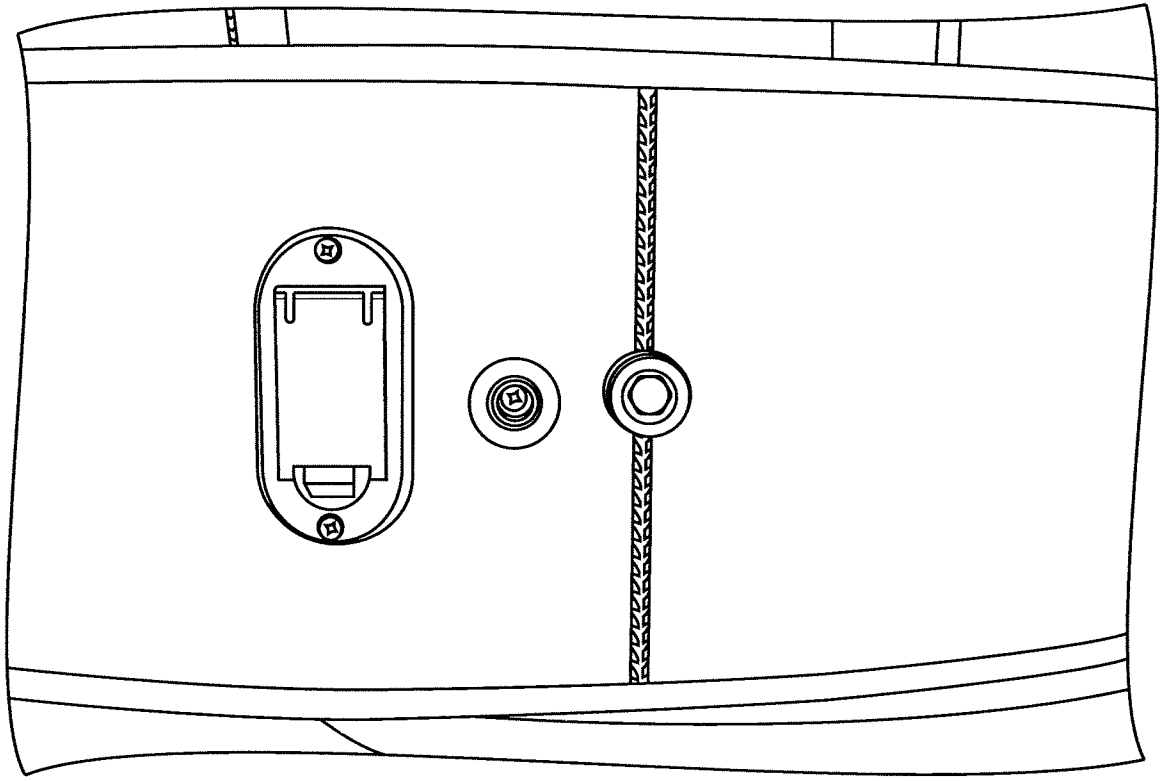
FIG. 7 PRIOR ART
FIG. 7 is a close up perspective view of the bottom of a prior art acoustic guitar body as modified with a strap button installed.
Figure 8A:
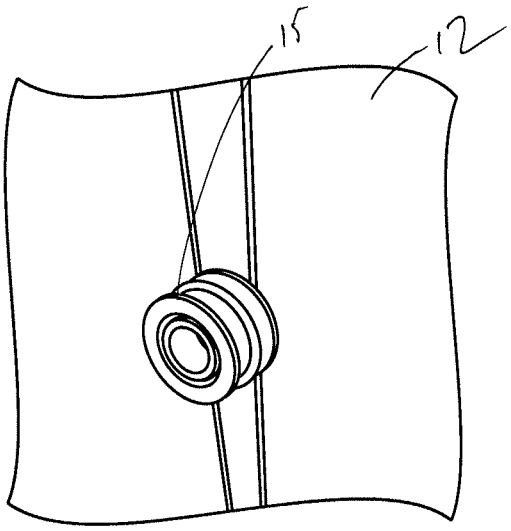
FIGS. 8A-8D are close up perspective views of a strap lock adapter being installed on an acoustic guitar, in accordance with an embodiment.
Figure 8B:
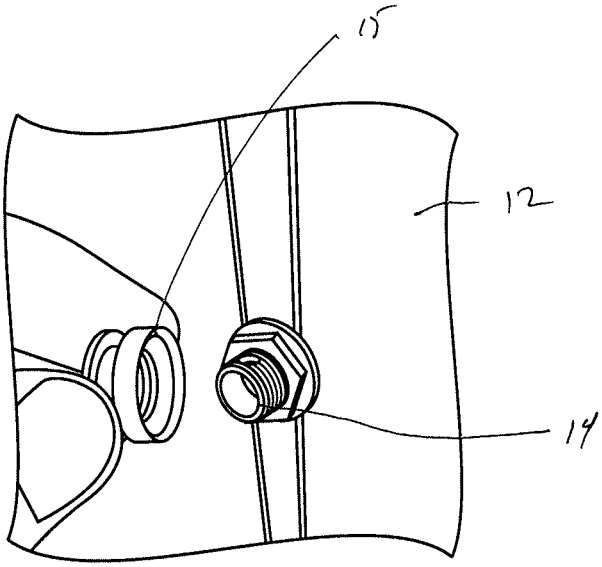
Figure 8C:
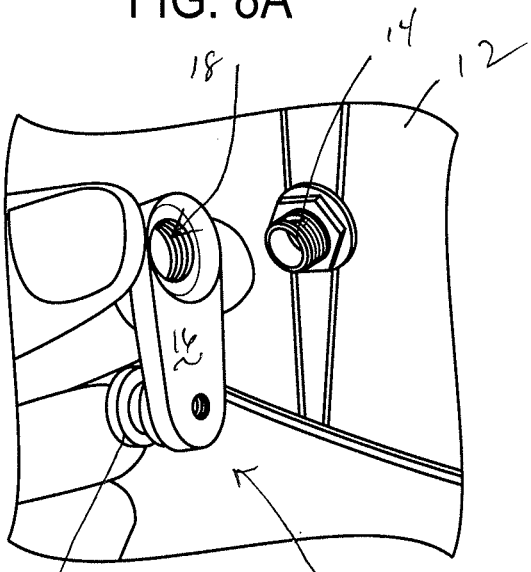
Figure 8D:
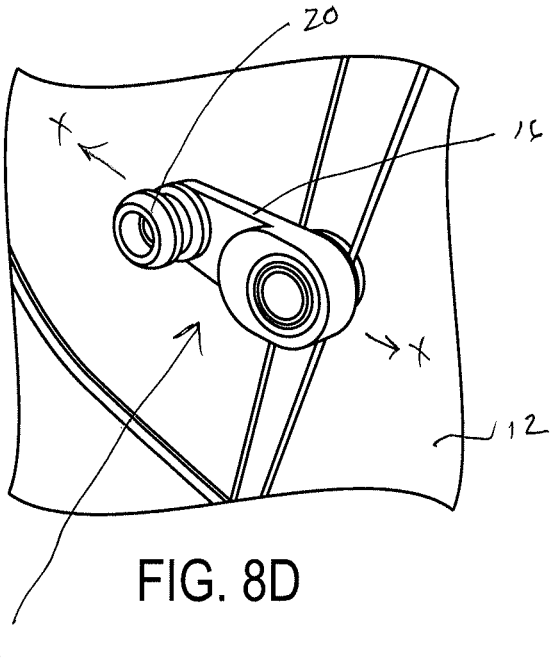
Figure 9:
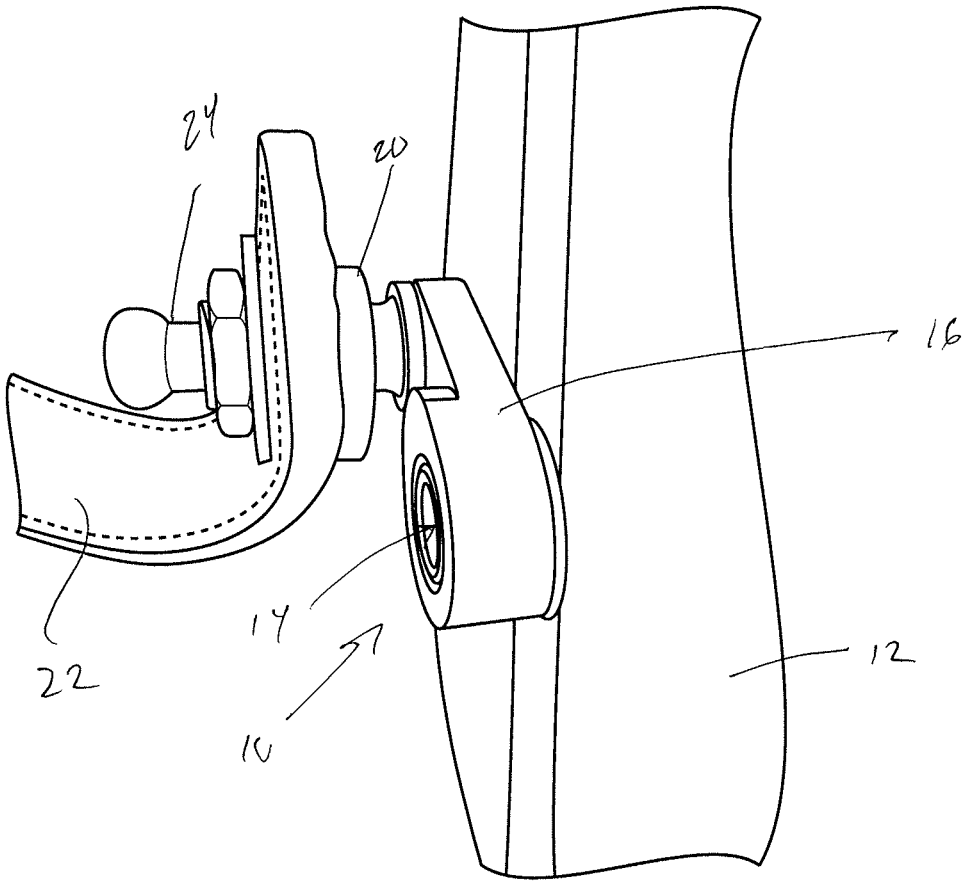
FIG. 9 is a close up perspective view of strap lock and strap attached to an acoustic guitar, in accordance with an embodiment.

Referring to FIGS. 8 and 9, in one embodiment, is an acoustic guitar strap lock adapter, designated generally by reference numeral 10, and used on a performance ready acoustic guitar 12 having an electronic pick up jack 14 (with cap 15). Strap lock adapter 10 generally comprises a generally planar, elongated body 16 that extends along a longitudinal axis X-X and has an internally threaded opening 18 formed through a first end and includes a strap lock button 20 extending outwardly from and attached to/integrated with the opposite, second end to which the strap lock 21 can connect.

To use strap lock adapter 10, a player would first remove the jack cap 15 off of the pick-up jack 14, as shown in FIGS. 8A and 8B. Next, the internally threaded opening 18 is placed over and threaded onto pick up jack 14, as shown in FIG. 8*c*, leaving space through opening 18 for a jack to be inserted into the pick-up. Once threaded onto the pick-up jack 14, the adapter 10 is rotated until the strap button 20 is positioned as desired, preferably straight inwardly from pick up jack 14 and essentially staying centered on the body of guitar 12, as shown in FIG. 8D. With reference to FIG. 9, a guitar strap 22 can be attached to adapter 10 by placing a lock 24 in engaged relation to button 20 is a typical fashion. The opposite end of strap 22 would, of course, be attached to the neck of the guitar 12 in typical fashion as well.

Figure 13:
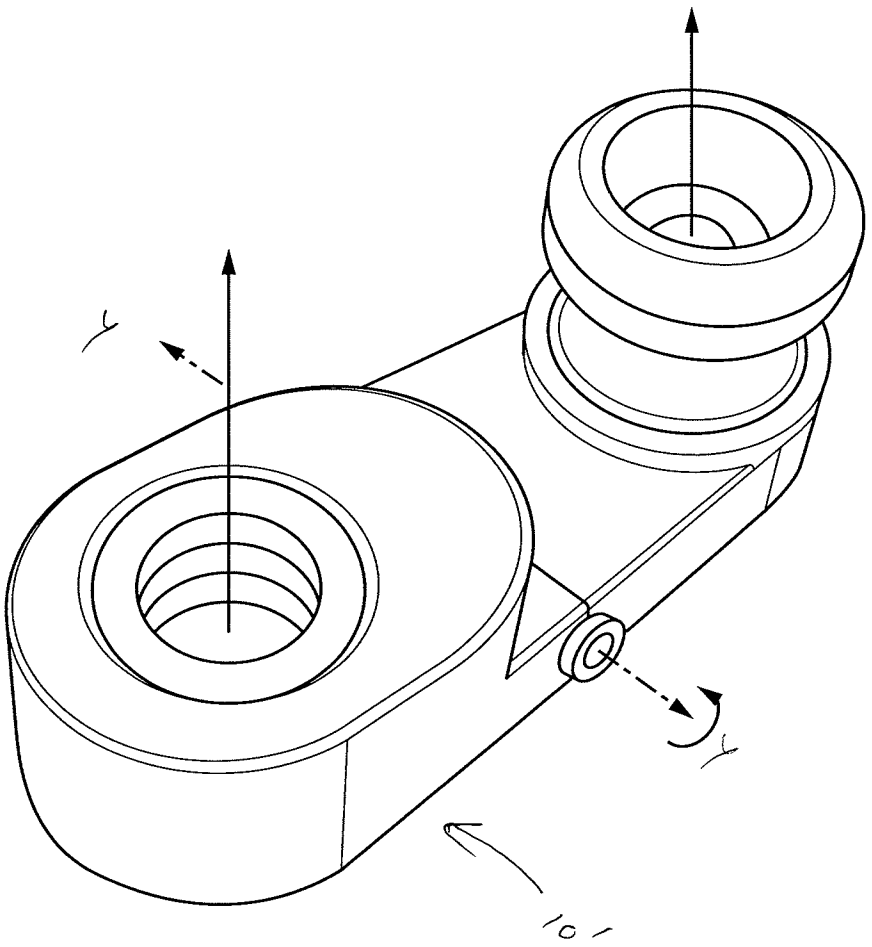
FIG. 13 is a perspective view of a strap lock adapter, in accordance with an embodiment.

In an alternate embodiment, see FIG. 13, the body of adapter 10' can be articulated such that it pivots about axis Y-Y, thereby permitting orientation of strap button 20' to be altered as desired.

Figure 10:
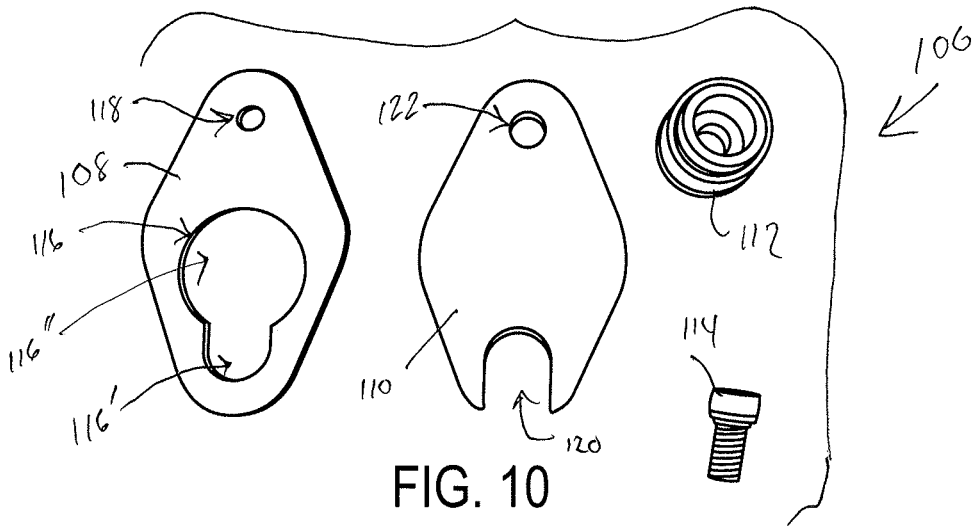
FIG. 10 is an elevation view of the parts to a strap lock adapter used in connection with an acoustic Taylor guitar equipped with a battery box for Expression System electronics, in accordance with an embodiment.
Figure 11A:
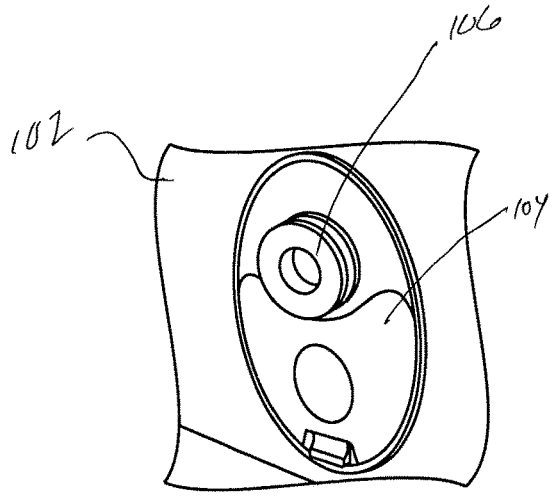
FIGS. 11A-11F are close up perspective views of a strap lock adapter being installed on an acoustic Taylor guitar, in accordance with an embodiment.
Figure 11B:
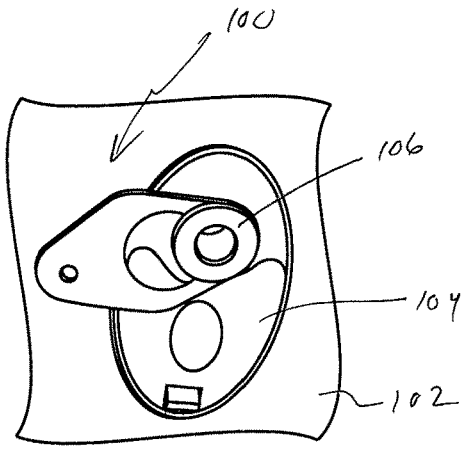
Figure 11C:
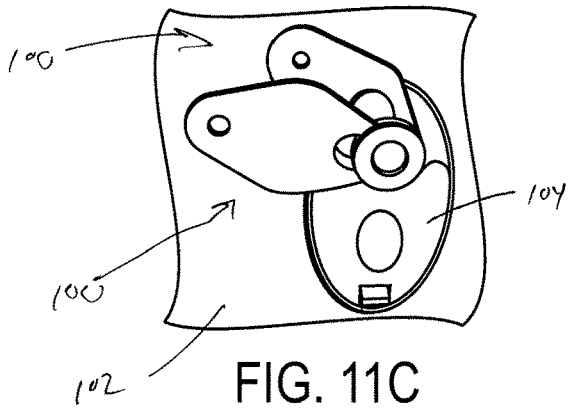
Figure 11D:
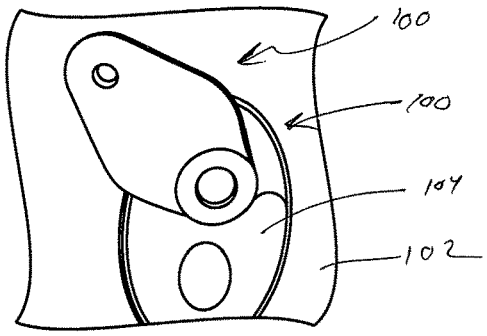
Figure 11E:
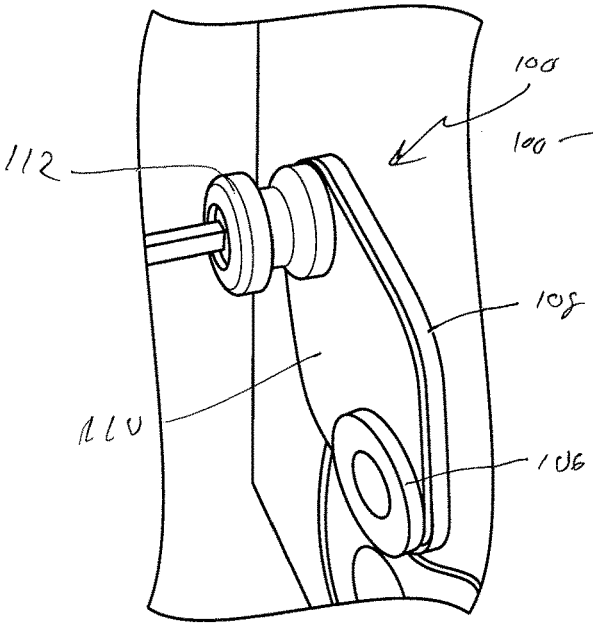
Figure 11F:
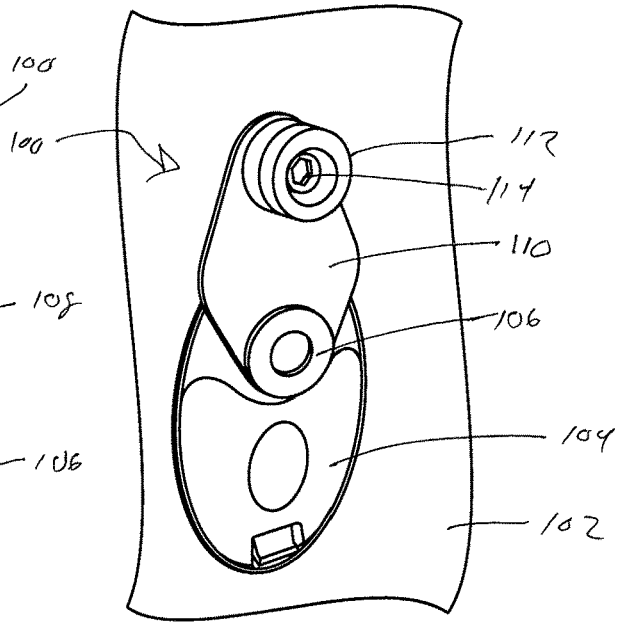
Figure 12:
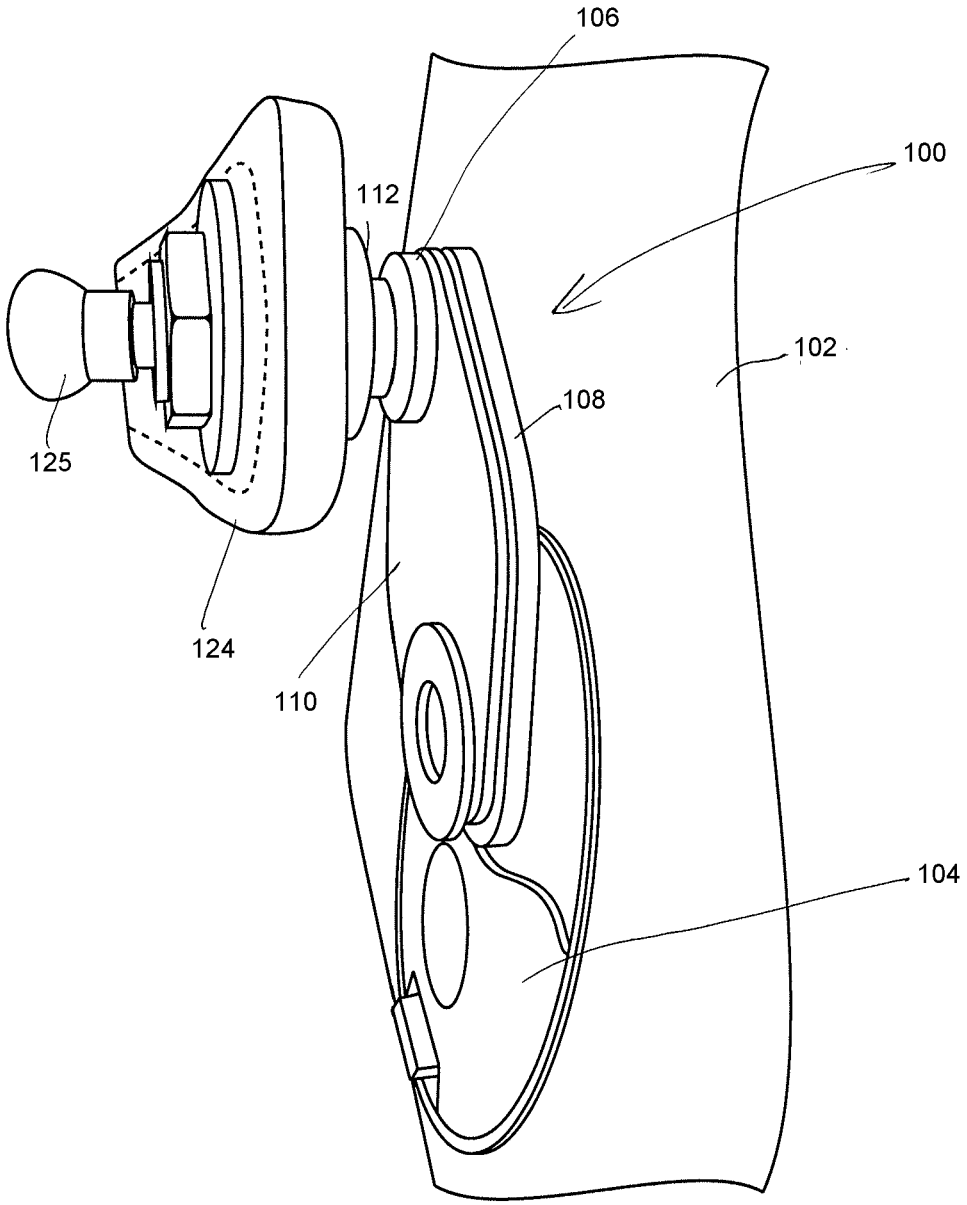
FIG. 12 is a close up perspective view of strap lock and strap attached to an acoustic Taylor guitar, in accordance with an embodiment.

Referring to FIGS. 10-12, in a second embodiment, is a guitar strap lock adapter, designated generally by reference numeral 100, for use specifically with a Taylor® acoustic guitar 102 having a battery box for Expression System electronics 104. Adapter 100 is designed to assemble onto the existing strap pin 106.

Adapter 100 generally comprises a keyhole ring 108, preferably composed of metal, a cover plate 110, preferably composed of plastic, a strap lock button 112 and an assembly screw 114, as shown in FIG. 10. With reference to FIGS. 11A-11F, installation of adapter 100 is illustrated. In FIG. 11A, the battery box for Expression System electronics 104 on the Taylor guitar is shown. Keyhole ring 108 comprises an elongated, essentially diamond shaped, relatively flat body having a slotted hole 116 (slot 116' leading into hole 116") formed therethrough adjacent one end thereof, and a smaller hole 118 formed therethrough adjacent its opposite end. Opening 116" is of large enough diameter to allow a pick-up jack to fit through the provided opening in the battery box for Expression System electronics 104, while slot 116' is of small enough width to prevent pick-up jack 104 from slipping out of and away from keyhole ring 108. As seen in FIG. 11B, keyhole ring 108 is placed the jack and slid such that slot 116' engages with the pick-up jack.

With reference to FIG. 11C, cover plate 110 comprises a flat, elongated, diamond shaped body similar in size and shape to key ring 108, and includes a slot 120 formed into on end thereof and a small hole 122 formed therethrough adjacent its opposite end. Cover plate 110 is placed over keyhole ring 108 and slot 120 is slid into engagement with the jack such that the jack 104 is straddled by the side edges of slot 120 and hole 122 is axially aligned with opening 118 as shown in FIG. 11D. Strap lock button 112 is placed in axial alignment with opening 118, 122 and assembly screw 114 is then passed therethrough to connect cover plate 110 to keyhole ring 108 and strap lock button 112 to provide the secure anchoring point for a guitar strap 124, as shown in FIGS. 11E-11F and 12.

With reference to FIG. 12, guitar strap 124 is locked in the typical manner using the strap lock button 114 and lock 125. Advantageously, adapter 100 offsets the strap lock from the pick-up jack, thus not impacting the effectiveness of the pick-up jack.

Both adapters 10 and 100 use familiar strap lock systems to prevent the acoustic guitar from inadvertently slipping off the strap, and do so without having to modify the guitar. Thus, a guitarist with the same style strap locks on multiple instruments can easily swap straps from guitar to guitar, while another guitarist that utilizes a unique locking mechanism on one guitar will only be able to use the strap dedicated to such mechanism.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A guitar strap lock adapter for use on an acoustic guitar having a pick-up jack on the body thereof, comprising:

a. an elongated body having first and second ends;

b. a first opening formed through the elongated body adjacent the first end thereof and being internally threaded to co-axially engage with the pick-up jack; and c. a lock button extending outwardly from the elongated body and positioned around a second opening formed through the elongated body adjacent the second end thereof and being configured to securely receive the strap lock therein, whereby the guitar strap can be anchored to the acoustic guitar at a position offset from the pick-up jack.

2. A guitar strap lock adapter for use on an acoustic guitar having a pick-up jack having a maximum diameter on the body thereof, comprising:

a. an adapter assembly of elongate shape that is configured and adapted for placement around the pick-up jack adjacent a first end thereof and having an opening formed therethrough adjacent a second end thereof offset from the first end;

b. a lock button positioned in axial alignment with the opening; and c. a fastening element for retaining the adapter assembly and lock button together.

3. The guitar strap lock adapter according to claim 2, wherein the adapter assembly comprises a cover plate and a keyhole ring.

4. The guitar strap lock adapter according to claim 3, wherein the keyhole ring comprises an elongated body having a first end adjacent which a first opening of predetermined diameter is formed and a first slot of predetermined width that intersects with the first opening is formed, and a second end adjacent which a second opening is formed.

5. The guitar strap lock adapter according to claim 4, wherein the predetermined diameter of the first opening is greater than the maximum diameter of the pick-up jack and the predetermined width of the first slot is smaller than the maximum diameter of the pick-up jack.

6. The guitar strap lock adapter according to claim 4, wherein the cover plate is of a shape essentially the same as the keyhole ring, and includes an elongated body having a first end through which a second slot is formed, and a second end adjacent which a third opening is formed.

* * * * *